US007297863B2

(12) United States Patent
May

(10) Patent No.: US 7,297,863 B2
(45) Date of Patent: Nov. 20, 2007

(54) ELECTRO-ACOUSTICALLY AMPLIFIED DRUM MIXER

(76) Inventor: Randall L May, 2 Trafalgar, Newport Beach, CA (US) 92660-6830

( * ) Notice: Subject to any disclaimer, the term of this patent is extended or adjusted under 35 U.S.C. 154(b) by 179 days.

(21) Appl. No.: 11/144,542

(22) Filed: Jun. 3, 2005

(65) Prior Publication Data

US 2006/0272490 A1 Dec. 7, 2006

(51) Int. Cl.
*G10H 3/00* (2006.01)

(52) U.S. Cl. ..... 84/723; 84/725; 84/730; 84/735; 84/737; 84/411 R; 84/104

(58) Field of Classification Search ..... 84/723
See application file for complete search history.

(56) References Cited

U.S. PATENT DOCUMENTS

| | | | | |
|---|---|---|---|---|
| 3,008,367 | A | 11/1961 | Parsons | |
| 3,192,304 | A | 6/1965 | Rizzutti | |
| 3,509,264 | A | 4/1970 | Green | |
| 3,549,775 | A | 12/1970 | Kaminsky | |
| 3,551,580 | A | 12/1970 | Glenn et al. | |
| 3,553,339 | A | 1/1971 | Dominguez et al. | |
| 3,621,749 | A | 11/1971 | Aluisi | |
| 3,725,561 | A | 4/1973 | Paul | |
| 3,956,959 | A | 5/1976 | Ebihara et al. | |
| 4,168,646 | A | 9/1979 | May | |
| 4,201,107 | A | 5/1980 | Barber, Jr. et al. | |
| 4,226,156 | A | 10/1980 | Hyakutake | |
| 4,227,049 | A * | 10/1980 | Thomson et al. | 381/93 |
| 4,242,937 | A | 1/1981 | Pozar | |
| 4,570,522 | A | 2/1986 | May | |
| 5,293,000 | A * | 3/1994 | Adinolfi | 84/730 |
| 5,353,674 | A * | 10/1994 | Volpp | 84/411 R |
| 5,606,142 | A * | 2/1997 | Volpp | 84/411 R |
| 6,121,528 | A * | 9/2000 | May | 84/411 R |
| 7,015,391 | B2 * | 3/2006 | Tomoda | 84/726 |
| 2006/0230912 | A1 * | 10/2006 | Pickens | 84/743 |

* cited by examiner

*Primary Examiner*—Marlon Fletcher
(74) *Attorney, Agent, or Firm*—Kirk A. Buhler; Buhler & Associates

(57) ABSTRACT

An electro-acoustically amplified drum mixer or sound level adjuster for amplifying a hollow drum shell having at least one open end, a drumhead spaced from the open end of the said drum shell and supported thereon. One or more microphones are supported on, and positioned within said drum shell and adapted for connection to an external amplifier and speaker. A second or additional microphones may be included with the internal mounting or may be adapted for mounting outside the drum housing. A proximal level adjustment or sound mixing mechanism is located on or near the drum to allow the performer to custom adjust the sound from the microphone(s)

20 Claims, 4 Drawing Sheets

ELECTRO-ACOUSTICALLY AMPLIFIED DRUM MIXER

FIELD OF THE INVENTION

This invention relates to an electro-acoustically amplified drum with a mixer. More particularly, the present invention relates to a drum with a drumhead on one or both ends of the drum, and one or more microphones. One microphone is placed within the drum and a second microphone is placed internal or external to the drum housing. A mixer or level control adjustment device is placed on the drum or within close proximity to the player of the drum such that the performer can make adjustments to the amplified level and or the mixing of more than one microphone.

BACKGROUND OF THE INVENTION

Several patents have been issued that provide some of the features proposed but none provide all the features that can be used on a conventional drum with sound level adjustment or mixing and the use or more than one microphone to create an electro-acoustically amplified drum. Placing a microphone inside a conventional drum has resulted in the amplification of a mixture of vibratory sounds has been musically acceptable. The ability to adjust the amplification level from one microphone and or mix the sound from more than one microphone creates unique sounds that may not be normally heard from a drum.

Green U.S. Pat. No. 3,509,264 discloses one attempt to amplify percussion instruments, including drums. In this patent, an electric pickup is cemented to the skin of a drumhead and vibrates adjacent to a magnet that constitutes the remainder of the pickup and is secured to a fixed part of the drum shell. An arrangement of this type may produce an amplification of vibrations of the drum skin but does not produce an amplification acoustically matching the sounds originating from the drum skin and by resonance from the drum shell.

Dominguez and Peake U.S. Pat. No. 3,553,339 discloses a drum-like instrument in which the diaphragm or skin carries one part of an electrical pickup and another part of the electrical pickup is supported on the shell. This device provides for amplification of the vibrations of the diaphragm or skin of the drumhead but does not provide for amplification of the acoustical sound mixture produced by the drum.

Ebihara and Serizawa U.S. Pat. No. 3,956,959 discloses a drum in which the diaphragm or skin of the drumhead carries a magnet that moves relative to a sensing element. This arrangement provides only for amplification of the vibrations from the drumhead and not of the mixture of acoustical sounds produced by the drum.

Parsons U.S. Pat. No. 3,008,367 discloses an electronic snare drum. This device consists of strings and strikers but has no drumhead. This patent also does not allow for sound level adjustment of mixing the sound from multiple microphones placed within and around the drum.

Rizutti U.S. Pat. No. 3,192,304 discloses electronic amplification of a banjo. The amplification is detected externally but not by an acoustical microphone. This patent also does not allow for sound level adjustment of mixing the sound from multiple microphones placed within and around the drum.

Kaminsky U.S. Pat. No. 3,549,775 discloses an amplifier arrangement for drums in which a speaker is connected to the sidewall of the drum shell. This patent also does not allow for sound level adjustment of mixing the sound from multiple microphones placed within and around the drum.

Glenn et. al. U.S. Pat. No. 3,551,580 discloses an electrical amplification of miniature drumheads. This patent also does not allow for sound level adjustment of mixing the sound from multiple microphones placed within and around the drum.

May U.S. Pat. No. 4,168,646 discloses the positioning of a fixed microphone inside a drum shell in which the drumhead is spaced away from the shell or other openings are provided to allow the drum to "breath". This patent represents an earlier development by the applicant that was successful in its purpose but did not allow for the amplification of drums not designed in this manner.

U.S. Pat. No. 4,570,522 issued Feb. 18, 1986 to May discloses a single microphone placed inside a drum utilizing the existing drum breather holes. The patent also allows for positioning of the single microphone with the drum. This patent also does not allow for sound level adjustment of mixing the sound from multiple microphones placed within and around the drum.

What is needed is a simple electro-acoustically amplified drum mixer or sound level adjuster where the performer can make the adjustments. The proposed invention provides this solution by providing sound level amplification adjustment for a microphone placed within the drum The adjustment can be made at or near the drum and allows for mixing and adjustment of multiple microphones for the drum. The proposed device satisfies these needs.

BRIEF SUMMARY OF THE INVENTION

The present invention relates to an electro-acoustically amplified drum mixer or sound level adjuster.

It is therefore an object of the present invention to provide to provide a new and improved adjustable amplification system for a drum having electro-acoustical amplification of the vibrations produced by the drumhead and the resonant components produced by the drum shell.

Another object of the invention is to provide an electro-acoustical amplification of a drum by means one or more microphones mounted at least one of the microphones within the drum shell on an adjustable mount which permits movement of the microphone for tuning.

Another object of this invention is to provide an improved mounting bracket for use with drum shells that provides for adjustment of the position and orientation of a microphone within a drum shell for one or more of the microphones.

Another object of this invention is to provide an improved microphone assembly for a drum shell including a bracket mountable on the drum shell that provides for adjustment of the amplification and or level from each microphone.

Another object of the invention is to provide a sound level or mixer apparatus where the sound level and or mixing can be accomplished by the performer as they are performing.

Still another object of the intention is to provide for one microphone to be installed within the shell of the drum, and additional microphones to be located inside, partially inside or completely outside the drum.

Various objects, features, aspects, and advantages of the present invention will become more apparent from the following detailed description of preferred embodiments of the invention, along with the accompanying drawings in which like numerals represent like components.

DETAILED DESCRIPTION

Figure 1:
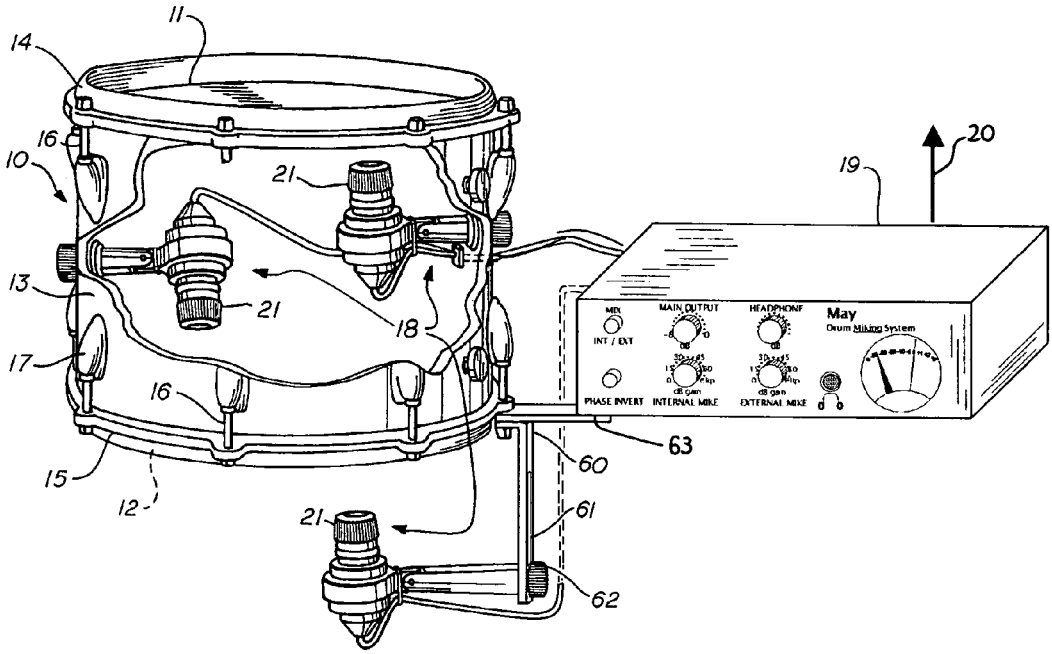
FIG. 1 is an isometric view of a drum assembly provided with microphones and schematically connected to a horizontally mounted level compensator, compressor/limiter.

Referring to FIG. 1 there is shown a drum assembly 10 that provides for electro-acoustical amplification. In FIG. 1, the drum assembly 10 consisting of upper and lower drumheads 11 and 12 that are supported on drum shell 13. Drumheads 11 and 12 are secured by tensioning hoops 14 and 15. Drum heads 11 and 12 are secured on the drum shell by conventional adjusting screws 16 which secure the tensioning hoops 14 and 15 to bosses 17 on drum shell 13. Adjustment of the bolts or screws 16 very the tension in the drum skin or diaphragm 11 and 12 to tune the output of the drumheads. The drum is shown in this figure with two drumheads 11 and 12, but the apparatus proposed only one drumhead is required.

Microphone assemblies 18 are provided. Two of the microphones are shown located inside the drum shell 13, and an alternative or third microphone assembly 18 is shown located outside the shell of the drum. The microphones are connected to a level compensator, compressor/limiter 19. The signal 20 from the level compensator, compressor/limiter is then output for additional signal processing, amplification and to speakers. The connection to the level compensator, compressor/limiter 19 and to further signal processing 20 is by means of a conventional jack, described below, and connector wire. Microphone assembly 18 includes a microphone 21 that is movable inside or outside the drum shell by means of an external adjusted mechanism, described below, to tune the sound output from the drum to the level compensator, compressor/limiter 19. Details of construction of microphone assembly 18 and microphone 21, as well as the supporting and adjusting mechanism therefore as shown further in FIGS. 3, 4, 5 and described below.

From FIG. 1 the two microphones shown with the drum are shown with the microphone element 21 facing opposite drum heads. If the bottom drumhead is removed, one microphone may be facing the open end of the drum. It is also contemplated that the single mounted microphone may contain multiple microphone elements facing opposite directions. As shown in this FIG. 1 one microphone may be mounted within the drum, and the second microphone be mounted outside the drum shell. The two different microphones are subjected to differing environmental resonance base upon their proximity to the drumhead and the conditions such as floor, walls or padding located outside the drum.

Figure 6:
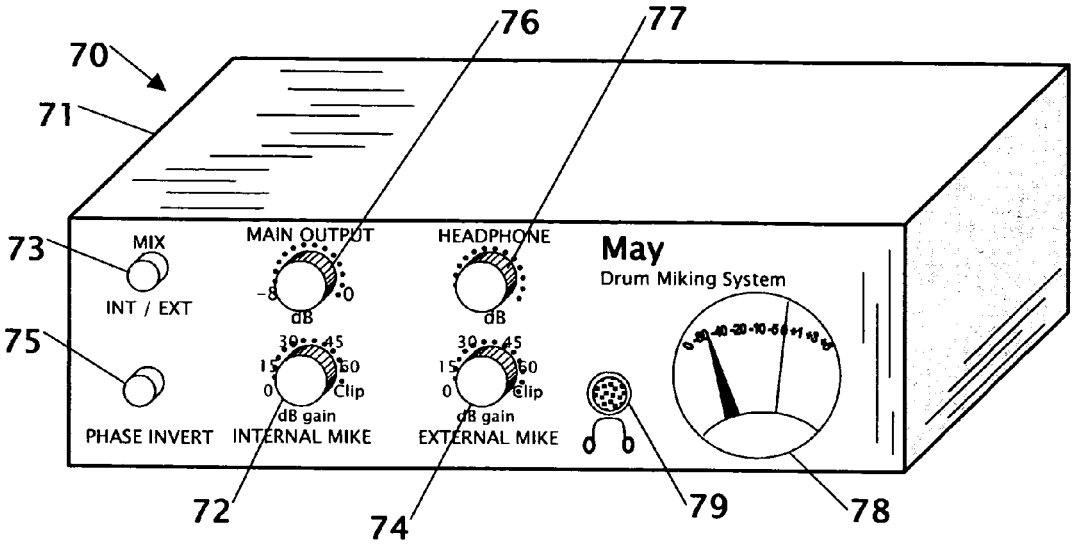
FIG. 6 is a front isometric view of one embodiment of the level compensator, compressor/limiter.
Figure 7:
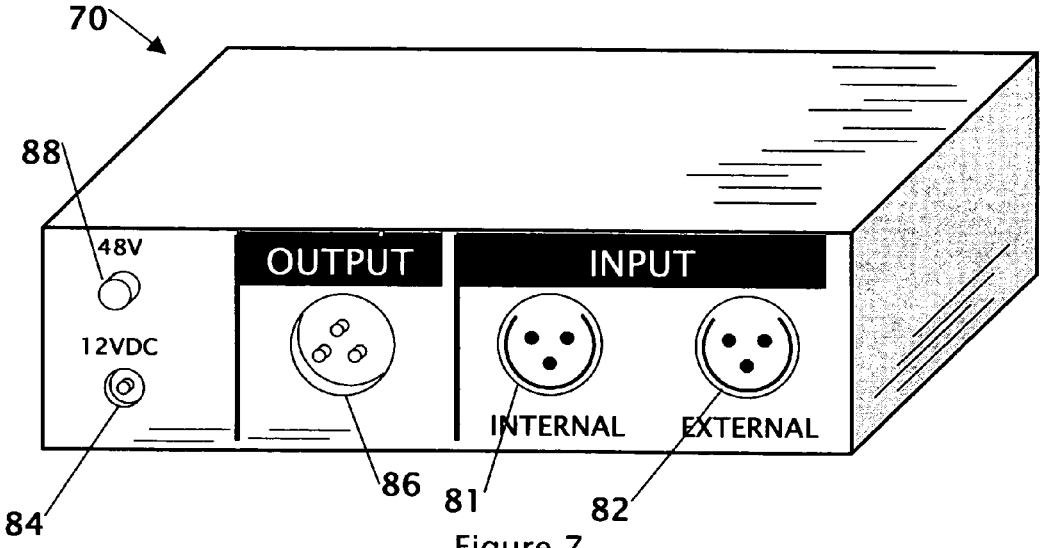
FIG. 7 is a back isometric view of one embodiment of the level compensator, compressor/limiter.

The signal from each microphone is sent to a level compensator, compressor/limiter. If only one microphone is utilized, the amplification level from the single microphone can be adjusted. If multiple microphones are used the sound level and or mixing of the sounds can be achieved buy the level compensator, compressor/limiter. The details of the level compensator, compressor/limiter are described in more detail when FIGS. 6, and 7 are discussed. The level compensator, compressor/limiter is located on or within close proximity to the performer so they can make level and or mixing adjustments to the sound as the play the instrument. A mounting bracket 63 is shown in FIG. 1 connecting the level compensator, compressor/limiter to the drum using the existing hardware from the drum. The level compensator, compressor/limiter is shown mounted in a horizontal orientation, but the level compensator, compressor/limiter can be mounted in a vertical orientation, on a swivel arm, or on a gooseneck that allows the performer to move the level compensator, compressor/limiter. The proximity of the level compensator, compressor/limiter to the performer, gives the performer the ability to adjust the sound prior to additional signal processing. This adjustment to the sound can be made simultaneously while the performer is playing.

Figure 2:
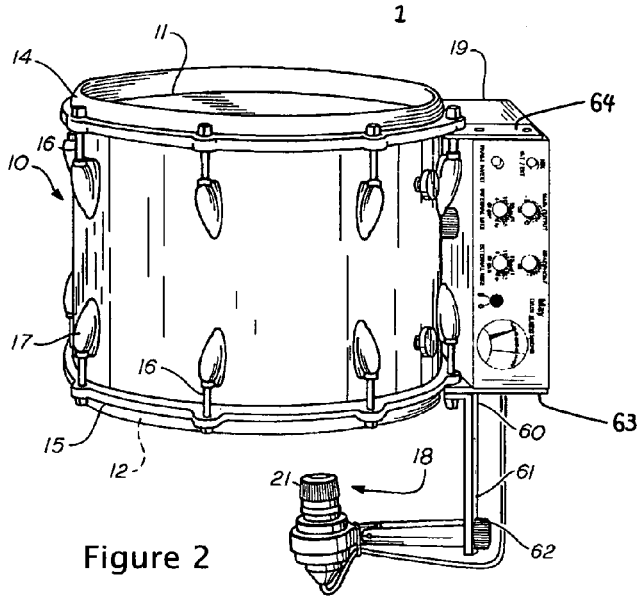
FIG. 2 is an isometric view of a drum assembly provided with microphones and schematically connected to a vertically mounted level compensator, compressor/limiter.

Referring to FIG. 2 there is shown a drum assembly 10 which has provided for electro-acoustical amplification where the level compensator, compressor/limiter is mounted in a vertical orientation for access to the performer while playing the electro-acoustical amplified drum. In FIG. 2, the drum assembly 10 consists of upper and lower drumheads 11 and 12 that are supported on the drum shell. Drumheads 11 and 12 are secured by tensioning hoops 14 and 15. Drum heads 11 and 12 are secured on the drum shell by conventional adjusting screws 16 which secure the tensioning hoops 14 and 15 to bosses 17 on drum shell 13. Adjustment of the bolts or screws 16 very the tension in the drum skin or diaphragm 11 and 12 to tune the output of the drumheads. The drum is shown in this figure with two drumheads 11 and 12, but the apparatus proposed only one drumhead is required.

An external microphone assembly 18 is shown. An additional microphone can be located within the drum shell. The microphones are connected to a level compensator, compressor/limiter 19. If only one microphone is utilized the amplification level from the single microphone can be adjusted. If multiple microphones are used the sound level and or mixing of the sounds can be achieved buy the level compensator, compressor/limiter. The details of the level compensator, compressor/limiter are described in more detail when FIGS. 6, and 7 are discussed. The level compensator, compressor/limiter is located on or within close proximity to the performer so they can make level and or mixing adjustments to the sound as the play the instrument. A mounting bracket 63 and 64 are shown in FIG. 2 connecting the level compensator, compressor/limiter to the drum using the existing hardware from the drum. The level compensator, compressor/limiter is shown mounted in a vertical orientation to provide the performer maximum access to the level compensator, compressor/limiter while he is performing. The proximity of the level compensator, compressor/limiter to the performer, gives the performer the ability to adjust the sound prior to additional signal processing. This adjustment to the sound can be made simultaneously while the performer is playing.

Figure 3:
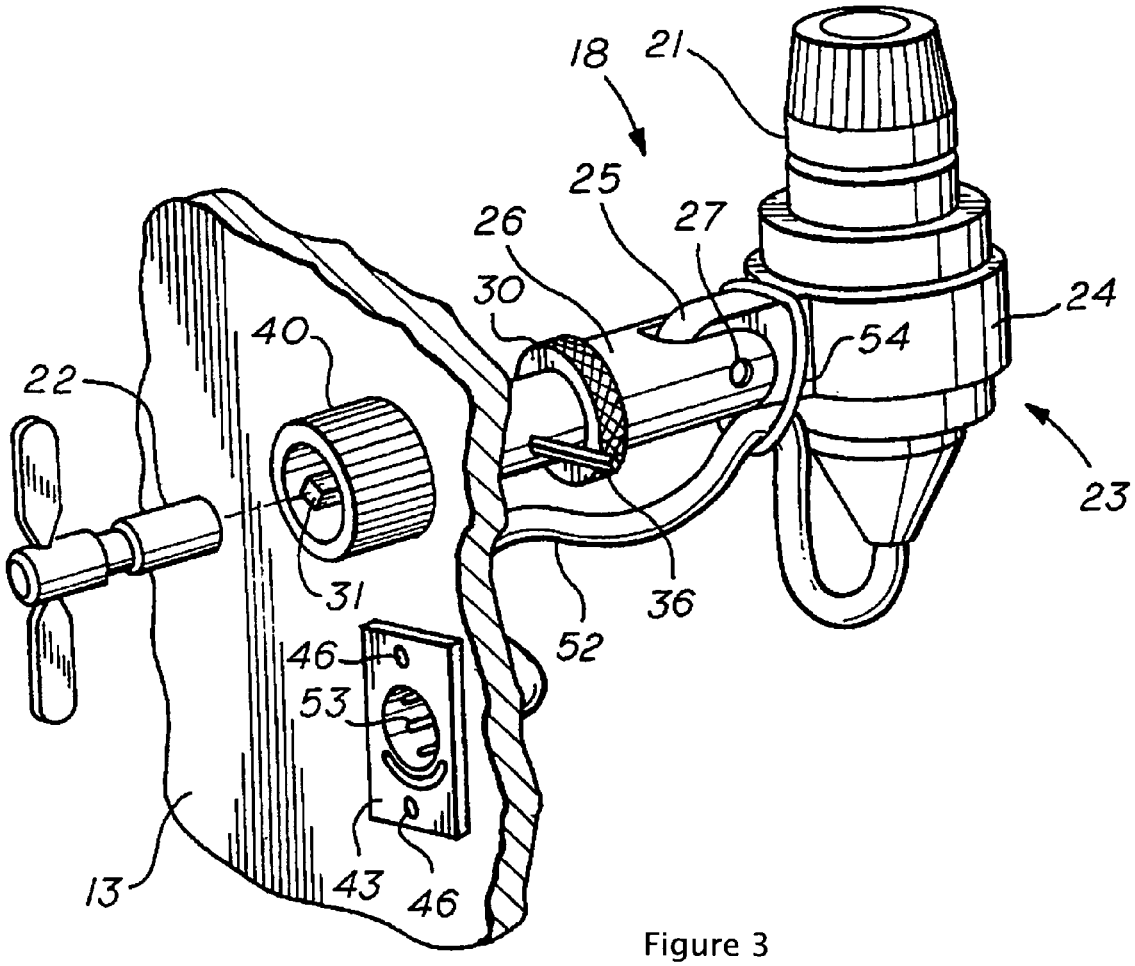
FIG. 3 is an isometric detail view of a portion of the drum shell and microphone shown in FIG. 1.
Figure 4:
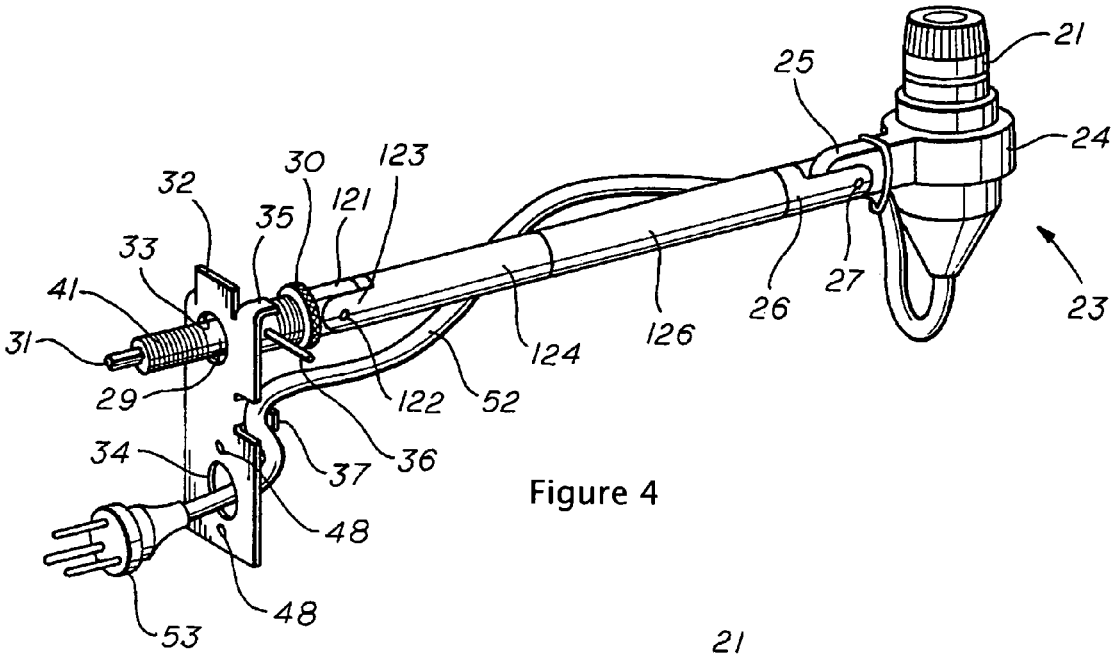
FIG. 4 is an isometric view of another embodiment of the drum assembly and mounting bracket for the drum assembly of FIG. 1.
Figure 5:
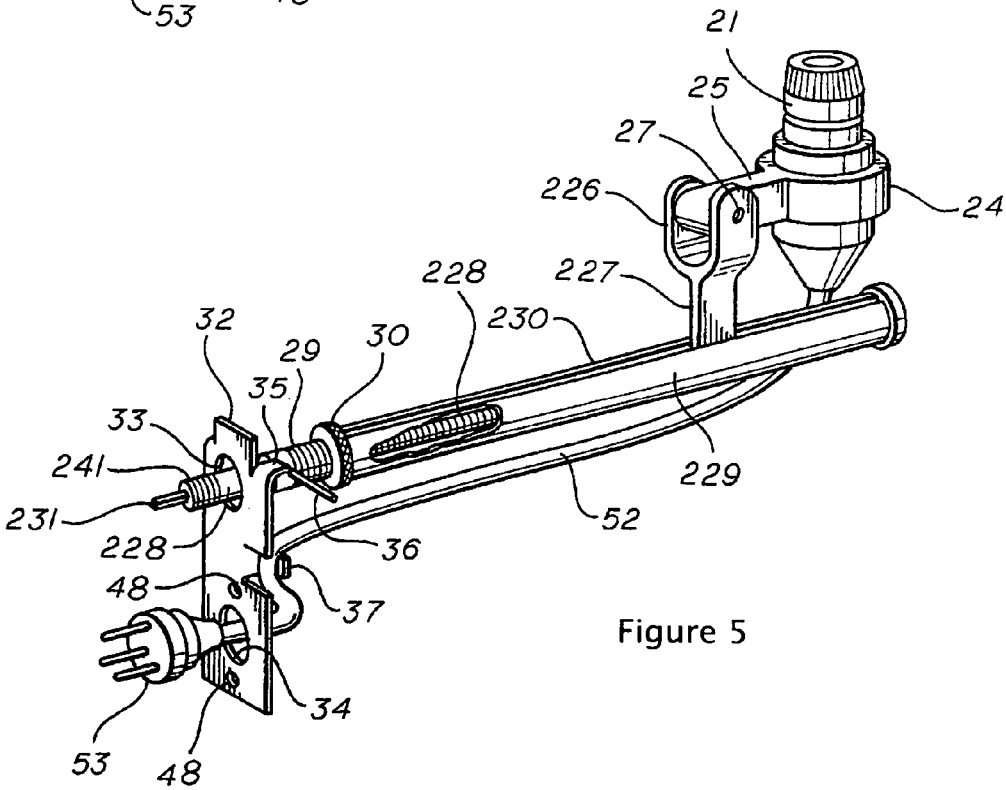
FIG. 5 is an isometric view of another embodiment of the drum assembly and mounting bracket for the drum assembly of FIG. 1, illustrating adjustment of the microphone radially of the drum.

Referring to FIGS. 3, 4 and 5, drum microphone assembly 18 consist of microphone 21 supported in shock mount 23. Shock mount 23 a hollow, annular supporting portion 24 with a tongue abutment 25 extending laterally therefrom. Tongue 25 is supported in cleaves on pivot bolt 27 which provides for pivotal or elliptical movement of the shock mount 23 and microphone 21.

Cleaves 26 is internally threaded (not shown) and receives the enlarged threaded end portion of mike rotation shaft 29. A lock nut 30 secures mike rotation shaft tightly on cleaves 26 after being screwed in place. The outer most end of mike rotation shaft 29 comprises a male adjustment portion 31 of square cross section that fits a like recess in drum key 22.

A stop plate 32 is secured on drum shell 13 and has an upper aperture 33, through which mike rotation shaft 29 extends and the lower aperture 34 that receives a mounting bracket for a microphone jack. Stop plate 32 has an inwardly extending projection providing a stop foot 35 that cooperates with role pin 36 extending from the enlarged end portion 28 of mike rotation shaft 29. Stop plate 32 is also slotted to provide a retainer 37 for the wires leading from microphone 21 to the external jack.

A hole is provided in drum shell 13 in which there is positioned a tubular nylon brushing. Mike rotation shaft 29 extends through the bushing and is retained in position by an external locking knob 40 that is threaded securely on the threaded end portion 41 of shaft 29.

A jack housing consist of an external plate 43 with a tubular extension extending through an aperture and drum shell 13. A lead or wire 52 extends from microphone 21 to a three-ten jack 53. Lead wire 52 is secured adjacent to microphone 21 by wire tie 52 and is secured adjacent to stop plate 32 by retainer 37. Jack 53 is positioned in the external plate of jack mount or housing and is secured to the plate or drum shell. The plate can be secured to the housing using screws in holes 46 or 48 depending upon the configuration of the mounting plate.

The position of an external microphone shown in FIG. 1 is adjusted by moving the microphone by loosening nut 62 on arm 60 in slot 61. When the nut is loosened the position of the microphone can moved from within the drum, to several inches or feet below the drum. It is also contemplated that the microphone can be rotated to some angle or inverted so the microphone picks up sound bounced off the ground or other surface.

Before describing the assembly and operation of this apparatus further, a short description will be given of the problem that are encountered in amplification of sound coming from different directions to a microphone.

Factors in Microphone Design and Placement

Three of the major factors involved in the design and placement of microphones are polar response of a microphone, microphone interference, and proximity effect. A microphone polar response is an indication of its sensitivity to sounds originating at any point along the circumference of a circle drawn around the microphone. Microphone interference, which is also called acoustic phase cancellation, results from misplacement of a microphone so that sounds are received at different times. Proximity effect is the variation in frequency response caused by a variation in working distances from the microphone.

The problem of polar response of a microphone mostly concerns a cardioid or uni-directional microphone. Microphone polar patterns may be divided into three main categories, viz. uni-directional (cardioid), bi-directional and omni-directional.

In measuring polar response of microphones, the polar response curve is usually drawn on a piece of circular graph paper with approximately five progressively larger circumferences. Each circumference usually indicates a difference of sensitivity of five decibels from the next adjacent circumference. The radial lines on such a graph indicate the direction from the microphone. If a graph is examined showing a curve for a cardioid or uni-directional microphone it is noted that the response curve touches the outer circumference from the point labeled 0 degrees to a point just before the 60 degree mark to either side. From thereon the curve slopes inward until at the 180 degree point it touches one of the innermost circumferences on the other side of the 180 degree point, the curve is a mirror image of the section just described.

If you consider the example of a constant level point source of sound located at the 0 degree point on the outer circumference, as the sound source moves along the circumference toward the sixty degree mark no change in sound level occurs at the microphone. As the sound source moves beyond the 60 degree point, it would have to move progressively closer to the microphone in order for the sound level arriving at the output of the microphone to remain the same. If the sound source remains at the same distance at the 180 degree point that it was at 0 degrees the microphone would attenuate the sound by 20 decibels (in this particular example). In plotting the polar response of a microphone, the sound source is usually in a fixed location and the microphone is rotated at a fixed distance. This can be carried out for any type of microphone although the graph produced is different for uni-directional microphones, bi-directional microphones and omni-directional microphones.

The problem of microphone interference can be seen by examining the problem of the positioning of the sound source between two separate microphones or the positioning of a single microphone between various sound sources. If two microphones are placed in spaced relation, a sound source must be positioned exactly equidistant between them to produce an accurate reproduction of the sound. If the sound source is positioned exactly in a central location and not changed in direction, it will not be distorted by separate microphones. However, if the sound source is moved or changed in orientation with respect to the microphones an acoustic phase cancellation takes place that results in distortion of the sound reproduced by the microphones. A similar effect takes place and a single microphone is varied in position relative to separate sources of sound.

If two or more microphones must be used to produce a wide angle of acceptance to cover a moving sound source, it is preferred to have the microphones relatively close together and point it at an angle to provide an angle of acceptance of about 90 degree-180 degrees. As an example of the problem that it had encountered, consider the situation of positioning a number of microphones in relation to enlarge orchestras. If one musician is working about two feet from his microphone, the next adjacent microphone should be at least 6 feet away. The three to one ratio of spacing was established from a long series of tests and is reported in the literature dealing with microphone design and application.

The variation in frequency response caused by a variation in working distance from the microphone is known as proximity effect. This variation occurs in the low frequencies at distances of about 2 feet or less. The proximity effect characteristics of a single diaphragm microphone may be but to good use if the microphone is used correctly. This effect may add depth and fullness to a thin sound source. The distance should be closely maintained, however, once an effective working range is found, so that the boosted low-end response remains constant.

The electro-acoustic amplified drum assembly shown in FIGS. 1-4 is mounted easily inside the drum shell and can be level compensator/mixer. This equipment mikes the internal acoustics of the drum in which it is mounted. This eliminates microphone leakage phase cancellation. The microphone can be rotated 180 degrees which allows each drum to be individually equalized to balance tone and volume and to isolate a wide range of internal frequencies.

Assembly and Operation

To assemble the apparatus on an existing drum, the drum set is first set up as under normal playing conditions. Next, all batter heads and hoops are removed. One then determines the location on each drum shell for placement of the electro-acoustical amplification apparatus. The acoustic and electro-acoustic sound properties are not affected by the radial location of the miking system for small size drums. One must keep in mind, however, the accessibility of external cables and jacks or snakes when determining location.

A template is first taped on the selected location of the drum shell after measuring the distance between the lugs so that the centerline on the template is centered between the lugs and perpendicular to the edge of the drum. For small templates, as in the case of a five-inch snare drum, the template mounts horizontally. Each drum to be miked is removed from its stand and secured on a clean padded work surface to prevent the drum from moving when punching and drilling.

A center punch is used to dimple the centers of the two large holes and the two small holes marked on the template. With the shell held firmly in place, the two larger holes and the smaller screw holes are drilled perpendicular to the shell. In the case of metal shells, the holes should be drilled by a drill press. It is recommended that a drum repair or machine shop drill the holes in metal shells. Masking tape applied to the backside of the drilling area on wood drums prevents splintering if excessive pressure is not applied when drilling. The template is discarded after the drilling operation is complete.

Next, the microphone assembly is prepared for installation. The microphone assembly is normally supplied with the various parts loosely assembled. First, external locking knob 40 is unscrewed from microphone rotation shaft 29 and the nylon bushing 39 is removed therefrom. Stop plate 32 is left in place. Nylon bushing 39 is inserted into hole 38, usually ½ inch in diameter, from outside the shell.

If the shell is especially thin, shorter bushings may be used and O-ring spacers as well, to fill the void between the shell an the end of the bushing. Shells which are substantially less than the ⅛ inch thickness may require additional flat washers. From inside the shell, microphone rotation shaft 29 is inserted into the hole 33 and through bushing 39. The external locking knob 40 is screwed loosely onto the threaded end portion 41 of shaft 29. It should be noted that roll pin 36 must be positioned under stop foot 35 as indicated in FIGS. 4 and 5.

Next, the pin jack 53 is pushed through stop plate 32 so that the jack hangs outside the shell. Jack housing is then slid on jack 53 and the set screw is tightened to secure the parts together. The assembled jack housing and jack are then inserted into larger hole and attached to drum shell 13 by screws. The screws extend through the aligned holes 46 or 48. Star washers are positioned on the inner end portions of the screws. Nuts are then screwed down tight to secure plate 32 and jack housing together. Next, the microphone rotation shaft 29 is held stationary with drum key 22 and locking knob 40 is turned clockwise to tighten and secure the microphone assembly.

At this point, the microphone assembly 18 is securely installed in drum shell 13. Shock mount 24 is adjusted in supporting clevis 26 to the desired orientation with respect to the drumhead. Next, the drumheads are replaced and the tensioning rings tightened to the degree desired for satisfactory sound. The jack 53 is then plugged into level compensator, compressor/limiter 19 and the sound output for further signal processing 20 as shown in FIG. 1. Drum key 22 is inserted over square end 31 of shaft 29 to rotate the shaft and the microphone mount 24 and microphone 21 to the amount necessary to produce the desired pitch and tone.

This electro-acoustical system is effective to reproduce accurately a wide range of frequencies. Consequently, will perform only as well as the drums are tuned. It is usually necessary on determining the desired pitch of each drum that each head be accurately tuned to itself. If necessary, drumheads may be replaced. If the drum is normally dampened to shorten the fundamental tone, it will still be necessary to use damping procedures as the amplification system has no effect on the length of the fundamental. This amplification system is effective to isolate a wide range of frequencies with its cardioid pick-up pattern. Coupled with the radial rotation by means of microphone rotation shaft 29, it is possible to isolate the frequency response to best reproduce the desired tonality of each drum.

The system designed allows each drum to be individually equalized (boost and/or cut off high and low frequencies). Acoustic equalization is achieved by rotating microphone 21 and also taking advantage of proximity effect, i.e. a variation in frequency response caused by variation in working distance from the microphone. To rotate microphone 21 radially external locking nut 40 is loosened and drum key 22 is used to turn the microphone rotation shaft 29.

After the desired position is located, the shaft is held steady with drum key 22 and external locking knob 40 is tightened to secure the assembly in place. The equipment has been designed to work primarily with cardioid (unidirectional) microphones. The adjustable features, however, permit its use with bi-directional and omni-directional microphones.

DESCRIPTION OF ADDITIONAL EMBODIMENTS

FIGS. 4 and 5 illustrate several additional embodiments of the apparatus that provide for installation in larger drum assemblies such as base drums and the like, and which provide for additional adjustments in positions of the microphone from outside the drum shell. Additional embodiments of mounting the microphone can be found in May U.S. Pat. No. 4,570,522, May U.S. Pat. No. 4,168,646.

FIGS. 4 and 5 show alternate embodiment for the positioning apparatus of the microphone within a drum. These embodiments include extension shaft 124, and 229. A second clevis pin 122 on shaft 123 and tongue 121 allow the microphone to be rotated up or down with the drum housing. A slot 230 shown in FIG. 5 allows the position of the microphone to be moved racially within the shell of the drum as microphone 226 holder "Y" 227 is moved on threaded shaft 228. Nut 40 is placed on threaded shaft 241 to retain shaft 29. A key can be used on square shaft 231 to adjust the location of the microphone with the drum.

In FIGS. 6 and 7 there is shown an embodiment of the apparatus designed for amplifying base drums or other large diameter drums. In this embodiment, the microphone mount and the supporting mechanism are the same as in FIGS. 1, 2, 3, 4 and 5, and the parts are given the same reference numbers. The main difference between this embodiment and the embodiment of FIGS. 1, 2, 3, 4 and 5 is that an extension is provided for supporting the microphone at a greater distance from the drum shell and therefore more centrally of a larger drum. In addition, the extension is provided with a pivotal connection that allows for a manual vertical adjustment of the microphone.

FIG. 6 shows a front isometric view of one embodiment of the level adjuster/mixer apparatus. The apparatus 70 consists of a housing 71 with adjustment knob 72 that adjusts the amplification or gain from a first microphone or an internal microphone, and adjustment knob 74 that adjusts the amplification or gain from a second microphone or a external microphone. A single main output knob 76 adjusts the combined level from the two microphones that is sent out of the unit. An adjustment knob 77 is also provided to adjust the amplification or sound level sent to headphones that may be connected 79 into the unit. A switch or potentiometer 73 allows the signals from the two microphones inputs to be mixed. The multiple position switch or potentiometer 73, can allow the signals from either microphone individually, finite or infinite blending of the signal from each microphone. In one embodiment, only one microphone is used and the device is used to adjust the amplification of a single microphone. A switch or button 75 inverts the phase from the two microphone inputs. The phase allows the signal from the microphones to be mixed to allow the music or sound waves to be blended in phase or in opposite phase with each other.

The level from the different input microphones and a sound level display indicator 78 allows the performer to visually see and adjust the amplification to of the signal. In the preferred embodiment the level adjuster/mixer is designed for use with two input sources or microphones. Other embodiments can be used that allow for a single microphone, or more than two microphones. In the preferred embodiment knob 72 controls the sound level from the microphone placed within the drum and knob 74 controls the second microphone that is placed opposing the first microphone, outside the drum, or any other configuration that is desired by the performer. Knob 76 sets the output amplification from the two-microphone sources.

FIG. 7 shows a back isometric view of one embodiment of the level compensator, compressor/limiter apparatus. Connection 84 is an electrical connection that provides power for the level compensator, compressor/limiter. In the preferred embodiment, the apparatus is powered with 12 VDC, but the apparatus could be powered internally with batteries or externally with 120 VAC or other power source. The back of the level compensator, compressor/limiter has several electrical connections. Connections 81 and 82 are for the internal and external microphone and connections respectively. Connection 86 is an output that connects the device to an additional amplifier or speakers. As was previously discussed if just one microphone is being used the level adjuster will have only one set of microphone connections. If more than two microphones are being used then the level compensator, compressor/limiter will have more connections than is shown and described in this figure. A button 88 provides excitation voltage to connected microphones. The power for excitation is typically 48 milivolts of phantom power supply, but the power source could be other varieties or types if the microphones require an alternative supply.

The mixer is intended for attachment or locating near or on the drum hardware so the performer can make adjustments to the sound from each microphone as they perform. It is contemplated that some songs may require a different or unique sound from one or more of the drums, and the performer can make adjustment(s) as they are playing to get the desired sound from the drum(s)

Thus specific embodiments and applications for an electro-acoustically amplified drum with a level compensator, compressor/limiter have been disclosed. It should be apparent, however, to those skilled in the art that many more modifications besides those described are possible without departing from the inventive concepts herein. Modifications besides those described may include providing a click track or tempo setter into the level compressor/limiter using a light and or audible indicator. The inventive subject matter, therefore, is not to be restricted except in the spirit of the appended claims.

What is claimed is:

1. An electro-acoustically amplified drum with an external level compensator comprising:

a hollow drum shell, a drum head closing at least one end of said drum shell, at least one microphone located internal to the hollow drum shell mounted by a vibration isolation member to mitigate mechanical vibration, and a level compensator removably attachable to the exterior of the drum wherein the level compensator can be adjusted by a musician playing the drum.

2. The electro-acoustically amplified drum from claim 1 wherein at least two microphones are located within the drum shell.

3. The level compensator from claim 1 wherein the compensator can mix the signal from more than one microphone located internal to the drum shell.

4. The electro-acoustically amplified drum from claim 2 wherein the at least two microphones can be oriented in opposing directions from each other.

5. The electro-acoustically amplified drum from claim 1 further includes at least a second microphone located at least partially outside the hollow drum shell.

6. The electro-acoustically amplified drum from claim 1 wherein a second drumhead covers the open side of the drum shell.

7. The electro-acoustically amplified drum from claim 1 wherein the hollow drum is made from a material selected from a group consisting of any plastic, wood, fiberglass, animal skin, metal, or fabric, natural, man made material or combination thereof.

8. The electro-acoustically amplified drum from claim 1 wherein the position, location, and or orientation of the at least one microphone can be adjusted.

9. An electro-acoustically amplified drum with a mixer comprising:

a hollow drum shell, a drumhead closing at least one end of said drum shell, at least one microphone located internal to the hollow drum shell oriented to receive sound from the at least one drumhead, at least a second microphone oriented to receive sound from the at least one drumhead, and a mixer that allows an operator playing the drum to mix the acoustic signals from the at least two microphones.

10. The electro-acoustically amplified drum from claim 9 wherein the at least two microphones can be oriented in opposing directions from each other.

11. The electro-acoustically amplified drum from claim 9 wherein the second microphone is located at least partially outside the hollow drum shell.

12. The electro-acoustically amplified drum from claim 9 wherein a second drumhead covers the open side of the drum shell.

13. The electro-acoustically amplified drum from claim 9 wherein the mixer can be attached to the drum.

14. The electro-acoustically amplified drum from claim 9 wherein the mixer allows sound level adjustment of each microphone.

15. The electro-acoustically amplified drum from claim 9 wherein the hollow drum is made from a material selected from a group consisting of any plastic, wood, fiberglass, animal skin, metal, or fabric, natural, man made material or combination thereof.

16. The electro-acoustically amplified drum from claim 9 wherein the position, location, and or orientation of the at least one microphone can be adjusted.

17. The electro-acoustically amplified drum from claim 9 wherein the mixer further allows the signals from the microphones to be inverted or non-inverted.

18. A performer adjustable drum microphone and level compensator, compressor/limiter comprising:

at least one microphone specifically designed for locating within a hollow drum shell, a level compensating mixer for allowing a performer to adjust the amplification level from the at least one microphone, and allowing the level compensator, compressor/limiter to be removably secured external to the hollow drum shell and placing the level compensator, compressor/limiter within reach of the drummer to allow the drummer to alter the level and mixing while performing.

19. The performer adjustable drum microphone from claim 18 that further includes at least a second microphone and the level compensating mixer can compensate and mix the signals from the microphones.

20. The performer adjustable drum microphone from claim 18 wherein the at least one microphone is mounted to the drum with a vibration isolation member.

* * * * *